US010899571B2

(12) United States Patent
Kimura et al.

(10) Patent No.: US 10,899,571 B2
(45) Date of Patent: Jan. 26, 2021

(54) SHEET PROCESSING APPARATUS

(71) Applicant: GLORY LTD., Hyogo (JP)

(72) Inventors: Tomohiro Kimura, Hyogo (JP); Hidetomo Yanagiuchi, Hyogo (JP); Hisashi Ishitobi, Hyogo (JP)

(73) Assignee: GLORY, LTD., Hyogo (JP)

( * ) Notice: Subject to any disclaimer, the term of this patent is extended or adjusted under 35 U.S.C. 154(b) by 22 days.

(21) Appl. No.: 16/174,322

(22) Filed: Oct. 30, 2018

(65) Prior Publication Data

US 2019/0127173 A1 May 2, 2019

(30) Foreign Application Priority Data

Oct. 30, 2017 (JP) ..... 2017-209237

(51) Int. Cl.

| | |
|---|---|
| ***B65H 29/60*** | (2006.01) |
| ***B65H 31/02*** | (2006.01) |
| ***B65H 29/12*** | (2006.01) |
| ***B65H 29/58*** | (2006.01) |
| ***G07D 11/18*** | (2019.01) |
| ***B65H 39/115*** | (2006.01) |

(Continued)

(52) U.S. Cl.

CPC ..... *B65H 29/60* (2013.01); *B65H 5/06* (2013.01); *B65H 29/006* (2013.01); *B65H 29/125* (2013.01); *B65H 29/58* (2013.01); *B65H 31/02* (2013.01); *B65H 39/115* (2013.01); *G07D 11/18* (2019.01); *G07D 11/40* (2019.01); *G07D 11/50* (2019.01); *B65H 2301/41912* (2013.01); *B65H 2301/4212* (2013.01); *B65H 2402/45* (2013.01); *B65H 2404/632* (2013.01); *B65H 2405/11151* (2013.01); *B65H 2407/33* (2013.01); *B65H 2601/523* (2013.01); *B65H 2701/1912* (2013.01)

(58) Field of Classification Search

CPC ..... B65H 29/58; B65H 29/60; B65H 29/62; B65H 29/585; B65H 31/24; B65H 2404/63; B65H 2404/631; B65H 2404/632; B65H 2404/633; G07D 11/18; G07D 11/50

See application file for complete search history.

(56) References Cited

U.S. PATENT DOCUMENTS 7,883,090 B2 * 2/2011 Ito ..... B65H 29/006 271/289
8,807,347 B2 * 8/2014 Yui ..... B65H 29/62 194/206

(Continued)

FOREIGN PATENT DOCUMENTS

JP 2012-174047 A 9/2012

OTHER PUBLICATIONS

Extended European Search Report for EP18203251.6 dated Mar. 4, 2019.

*Primary Examiner* — Jeremy R Severson
(74) *Attorney, Agent, or Firm* — Brundidge & Stanger, P.C.

(57) ABSTRACT

A sheet processing apparatus includes: an input section that receives a sheet; a dispensing section that dispenses the sheet; transporters that transport the sheet input through the input section, to the dispensing section; storages that store the sheet; and diverting sections that divert the sheet transported by the transporters, to the storages, wherein diversion points at which the sheet is diverted by the diverting sections are provided at positions higher than terminal ends of the transporters.

6 Claims, 3 Drawing Sheets

(51) Int. Cl.

| | |
|---|---|
| ***G07D 11/40*** | (2019.01) |
| ***G07D 11/50*** | (2019.01) |
| ***B65H 5/06*** | (2006.01) |
| ***B65H 29/00*** | (2006.01) |

(56) References Cited

U.S. PATENT DOCUMENTS

| | | | | |
|---|---|---|---|---|
| 9,245,401 | B2 * | 1/2016 | Nishino | B65H 31/24 |
| 2011/0304091 | A1 * | 12/2011 | Hirano | G06M 7/06<br>271/3.14 |
| 2016/0163160 | A1 | 6/2016 | Hosokawa et al. | |
| 2017/0309133 | A1 | 10/2017 | Okamoto et al. | |

* cited by examiner

SHEET PROCESSING APPARATUS

CROSS REFERENCE TO RELATED APPLICATIONS

This application is entitled to and claims the benefit of Japanese Patent Application No. 2017-209237, filed on Oct. 30, 2017, the disclosure of which including the specification, drawings and abstract is incorporated herein by reference in its entirety.

TECHNICAL FIELD

The present invention relates to a sheet processing apparatus that stores and ejects sheets.

BACKGROUND ART

Conventionally, a cash handling apparatus has been known that receives cash, such as banknotes, according to the content of a transaction with a customer, counts and stores the received cash, and dispenses the stored cash according to the count result (e.g., see PTL1).

CITATION LIST

Patent Literature

PTL1
Japanese Patent Application Laid-Open No. 2012-174047

SUMMARY OF INVENTION

Technical Problem

Such a cash handling apparatus is required by a user to be reduced in size in consideration of the installation space.

Unfortunately, reduction in size in turn requires reduction in the sizes of an operation unit, a cash storage and the like. Accordingly, there is a possibility that the operability of the apparatus is degraded and the amount of cash storage is reduced. Furthermore, the cash inlet and outlet have to be reduced in size, and cash inputting and dispensing become inconvenient; thus, there is possibility that the handling property of the apparatus is reduced.

An object of the present invention is to provide a sheet processing apparatus that securely achieves the operability, handling property, and amount of storage that are analogous to those of the conventional art, while facilitating reduction in the size of the apparatus.

Solution to Problem

In order to achieve the above objects, a sheet processing apparatus of the present invention includes: an input section that receives a sheet; a dispensing section that dispenses the sheet; a transporter that transports the sheet input through the input section to the dispensing section; a storage that stores the sheet; and a diverting section that diverts the sheet transported by the transporter to the storage, in which a diversion point at which the sheet is diverted by the diverting section is provided at a position higher than a terminal end of the transporter.

Advantageous Effects of Invention

The sheet processing apparatus of the present invention can securely achieve the operability, handling property, and amount of storage that are analogous to those of the conventional art, while facilitating reduction in the size of the apparatus.

DESCRIPTION OF EMBODIMENTS

An embodiment of the present invention is hereinafter described with reference to the accompanying drawings. The accompanying drawings schematically illustrate configuration elements for the sake of easy understanding.

Figure 1:
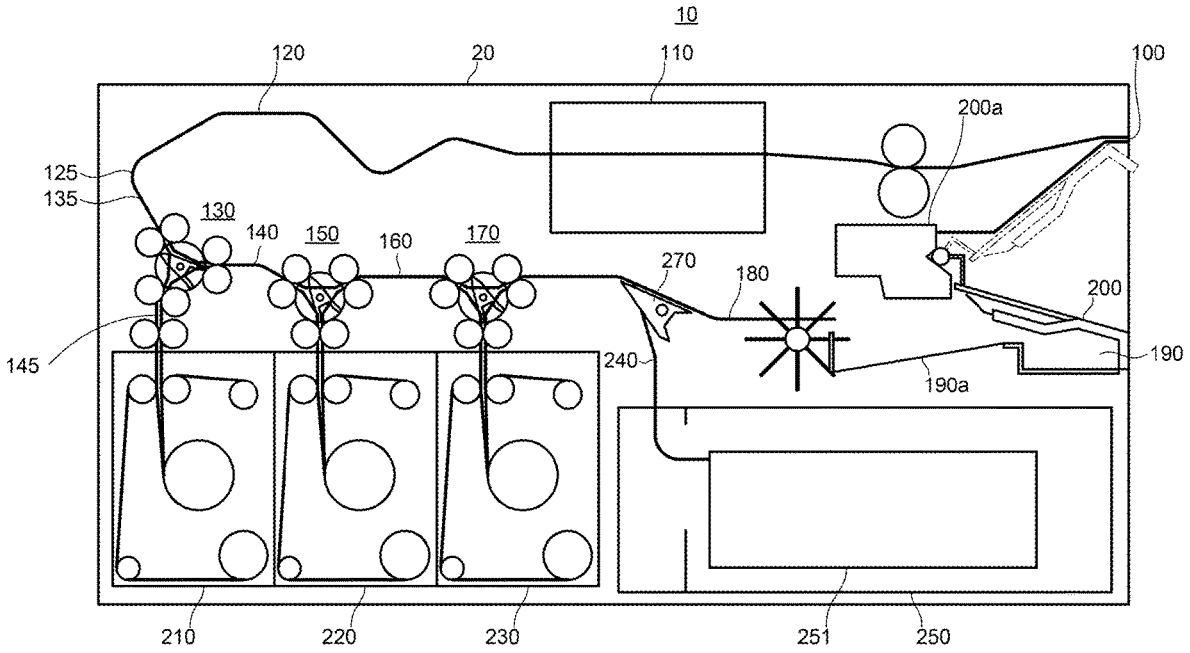
FIG. 1 is a left side sectional view illustrating a sheet processing apparatus according to an embodiment of the present invention.
Figure 2:
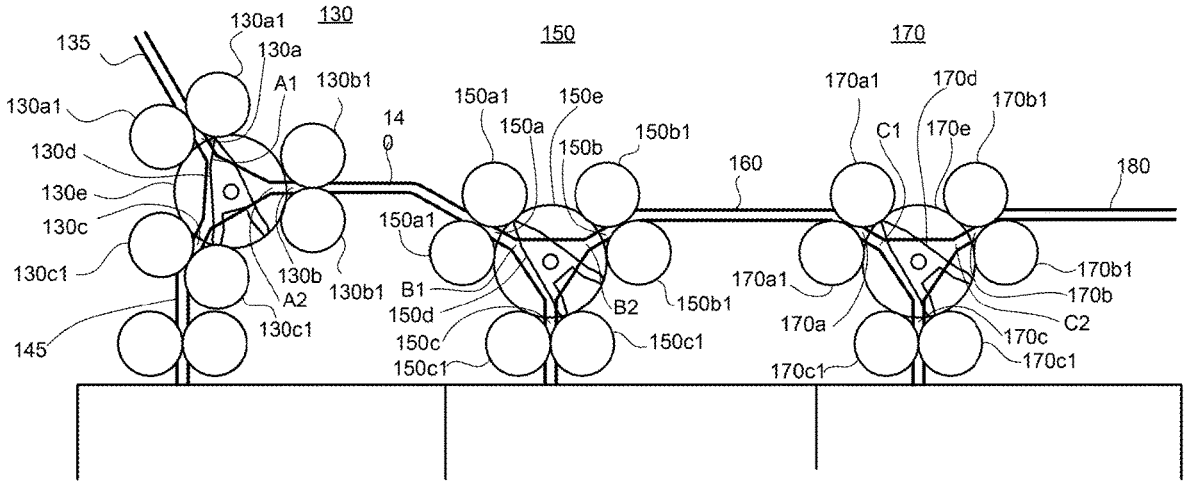
FIG. 2 is an enlarged left side sectional view around a first diverting section, a second diverting section, and a third diverting section.

FIG. 1 is a left side sectional view illustrating a sheet processing apparatus according to the embodiment of the present invention. FIG. 2 is an enlarged left side sectional view around a first diverting section, a second diverting section, and a third diverting section.

The sheet processing apparatus 10 according to the embodiment of the present invention includes a housing 20, an input section 100 provided on one side of the housing 20, a dispensing section 190 provided on the one side of the housing 20 and below the input section 100, and a shutter 200 that covers the dispensing section 190. The sheet processing apparatus 10 internally includes a first transporter 120 that transports a sheet to the other side, a turning-back section 125 that changes the transport direction from that toward the other side to that toward the one side, and a second transporter 135, a third transporter 140, a fourth transporter 160, a fifth transporter 180 and a sixth transporter 240 that transport the sheet to the one side. The sheet processing apparatus 10 internally includes a first storage 250, a second storage 210, a third storage 220 and a fourth storage 230 that store sheets. The sheet processing apparatus 10 includes a first diverting section 130, a second diverting section 150 and a third diverting section 170 that divert the sheet. The sheet processing apparatus 10 includes a control section (not illustrated) that controls the operation of each element. The first transporter 120 constitutes a first transport path section. The second transporter 135, the third transporter 140, the fourth transporter 160 and the fifth transporter 180 constitute a second transport path section.

Here, the one side or the first side is a side where the input section 100 and the dispensing section 190 are provided. Hereinafter, the side where the input section 100 and the dispensing section 190 are provided is called a front surface side. The other side or the second side is a side opposite to the one side. Hereinafter, the side opposite to the one side is called a rear surface side. The left direction of the sheet processing apparatus 10 viewed from the front surface side is called a left side. The direction from the one side (first side) to the other side (second side) is called a first direction.

The housing 20 has a box shape for storing each element, and includes the input section 100 and the dispensing section 190 on the front surface side. The housing 20 of the sheet processing apparatus 10 according to the embodiment of the present invention is formed to have a desktop size mountable on a table or the like.

The input section 100 is a receiving section for receiving input sheets. At the input section 100, an inlet is formed. A user inputs sheets through the inlet into the sheet processing apparatus 10. The input section 100 may be configured to receive sheets to be input one-by-one, or to receive multiple sheets collectively.

The first transporter 120 is a transport path for transporting the sheet input through the input section 100, to the rear surface side. The first transporter 120 transports the sheet fed by a pair of rollers provided above and below the first transporter 120. The first transporter 120 transports the sheet fed by a pair of endless belts (not illustrated) provided above and below the first transporter 120.

The endless belts are wound around multiple rollers (not illustrated). At least one roller among the rollers is rotatably driven. The driving force is transmitted to the endless belts, thereby rotating the endless belts.

FIG. 1 illustrates the mode where the first transporter 120 is formed to be bent multiple times in the vertical direction. Alternatively, the first transporter 120 may be linearly formed.

A recognition unit 110 is a recognition unit that recognizes the sheet input through the input section 100. The recognition unit 110 is provided at a position (a position in the first direction viewed from the input section 100) of the middle of the first transporter 120 (first transport path section) on the rear surface side of the input section 100. As will be apparent from the description below, the second transport path section resides below this position. The second transport path section is oriented toward a lower position as the path approaches the front surface side. Accordingly, the position is accompanied by a relatively large space. Consequently, by disposing the recognition unit 110 having a relatively large size at the position, the entire height of the sheet processing apparatus 10 can be reduced.

The recognition unit 110 includes sensors, such as an image sensor and a magnetic sensor. The recognition unit 110 further includes a memory section, such as a memory.

The recognition unit 110 compares information on the sheet read by the sensor with the information about the sheet stored in the memory section, and determines the type, the authenticity, damage and dirtiness and the like of the sheet.

The control section determines the storage where the sheet is to be stored among the second storage 210, the third storage 220 and the fourth storage 230, on the basis of the result of the determination of the type of the sheet by the recognition unit 110.

If the sheet is determined as a counterfeit note or determined to be heavily damaged by the recognition unit 110, the control section controls each section to store the sheet, as a sheet to be rejected, in the first storage 250. The sheet stored in the first storage 250 is collected by the user or the like of the sheet processing apparatus 10.

The turning-back section 125 is a transport path for changing the transport direction of the sheet transported on the rear surface side by the first transporter 120 to the front surface side. The turning-back section 125 is formed to have a circular-arc shape, and its one end is connected to the first transporter 120 and the other end is connected to the second transporter 135.

Note that the shape of the turning-back section 125 is not limited to the circular-arc shape. The turning-back section 125 may include a linearly formed transport path. For example, the turning-back section 125 may include a circular-arc-shaped transport path for changing, downward, the direction of the transport path oriented toward the rear surface side, a transport path formed linearly downward, and a circular-arc-shaped transport path for changing the direction of the transport path formed downward, to the front surface side.

The second transporter 135, the third transporter 140, the fourth transporter 160 and the fifth transporter 180 are transport paths for transporting, to the dispensing section 190, the sheet whose transport direction has been changed from that to the rear to that to the front at the turning-back section 125; the dispensing section 190 is disposed on the front surface side.

The second transporter 135 is a transport path that has one end connected to the turning-back section 125 and is formed obliquely downward and frontward from the turning-back section 125. The first diverting section 130 is connected to the other end of the second transporter 135.

The third transporter 140 includes a transport path that has one end connected to the first diverting section 130 and is formed from the first diverting section 130 horizontally to the front surface side, and a transport path formed obliquely downward and frontward from the horizontally formed transport path. The second diverting section 150 is connected to the other end of the third transporter 140.

The fourth transporter 160 is a transport path that has one end connected to the second diverting section 150 and is formed from the second diverting section 150 toward the front. The third diverting section 170 is connected to the other end of the fourth transporter 160.

The fifth transporter 180 includes a transport path that has one end connected to the third diverting section 170 and is formed from the third diverting section 170 horizontally frontward, a transport path oriented obliquely downward and frontward from the horizontally formed transport path, and a horizontal transport path formed toward the terminal end from the transport path oriented obliquely downward and frontward. The terminal end of the fifth transporter 180 is disposed above the dispensing section 190.

That is, the transport path (second transport path section) made up of the second transporter 135, the third transporter 140, the fourth transporter 160 and the fifth transporter 180, is formed stepwise. Note that the transport path (second transport path section) made up of the second transporter 135, the third transporter 140, the fourth transporter 160 and the fifth transporter 180 is not limited to such a shape. For example, this path may be linearly inclined below, or formed downward with a curved shape.

The first diverting section 130 is a diverting device that diverts the path to three directions and is for diverting the sheet.

The first diverting section 130 includes: a cylindrical diverting section main body 130*e*; a selector 130*d* that is stored in the diverting section main body 130*e* and turns centered at the central axis of the diverting section main body 130*e* as a turning center; three passage paths 130*a*, 130*b* and 130*c* formed to extend outward from the cylindrical surface of the diverting section main body 130*e*; and pairs of rollers 130*a*1, 130*b*1 and 130*c*1 provided on the respective passage paths.

The first diverting section 130 may be configured as an unit including the diverting section main body 130*e*, the selector 130*d*, the passage paths 130*a*, 130*b* and 130*c*, and the pairs of rollers 130*a*1, 130*b*1 and 130*c*1. Alternatively, each element may be configured as a separated member.

One passage path 130*a* among the three passage paths has an end connected to the second transporter 135. The first diverting section 130 feeds the sheet transported by the second transporter 135 to the inside by the pair of rollers 130*a*1 provided on the passage path 130*a*.

Another passage path 130*b* among the three passage paths has an end connected to the third transporter 140. For feeding the sheet toward the third transporter 140, the first diverting section 130 feeds the sheet by the pair of rollers 130*b*1 provided on the passage path 130*b*.

Still another passage path 130*c* among the three passage paths has an end connected to a transport path 145 connected to the second storage 210. For storing the sheet into the second storage 210, the pair of rollers 130*c*1 provided on the passage path 130*c* feed the sheet toward the transport path 145 connected to the second storage 210. For feeding the sheet stored in the second storage 210 into the first diverting section 130, the pair of rollers 130*c*1 provided on the passage path 130*c* feed the sheet to the inside.

A space having a substantially triangular prism shape is formed in the diverting section main body 130*e* of the first diverting section 130. The passage paths 130*a*, 130*b* and 130*c* are confluent in the space.

The selector 130*d* is formed to have an A-shape in left side view, and is provided turnably about a horizontal axis extending in the lateral direction. The selector 130*d* is controlled to have a predetermined attitude, thereby diverting the sheet fed into the space in the diverting section main body 130*e*, to a desired passage path.

Hereinafter, a position where a trajectory drawn by the sheet having passed through the passage path 130*a* and then been diverted to the third transporter 140, and a trajectory drawn by the sheet having passed through the passage path 130*a* and then been diverted to the second storage 210 branch off from each other is called a diversion point A1. A position where a trajectory drawn by the sheet having passed through the passage path 130*a* and then been diverted to the third transporter 140, and a trajectory drawn by the sheet having been stored in the second storage 210 and been fed toward the third transporter 140 become confluent is called a confluence point A2.

The second diverting section 150 is a diverting device that diverts the path to three directions and is for diverting the sheet.

The second diverting section 150 includes: a cylindrical diverting section main body 150*e*; a selector 150*d* that is stored in the diverting section main body 150*e* and turns centered at the central axis of the diverting section main body 150*e* as a turning center; three passage paths 150*a*, 150*b* and 150*c* formed to extend outward from the cylindrical surface of the diverting section main body 150*e*; and pairs of rollers 150*a*1, 150*b*1 and 150*c*1 provided on the respective passage paths.

The second diverting section 150 may be configured as an unit including the diverting section main body 150*e*, the selector 150*d*, the passage paths 150*a*, 150*b* and 150*c*, and the pairs of rollers 150*a*1, 150*b*1 and 150*c*1. Alternatively, each element may be configured as a separated member.

One passage path 150*a* among the three passage paths has an end connected to the third transporter 140. The second diverting section 150 feeds the sheet transported by the third transporter 140 to the inside by the pair of rollers 150*a*1 provided on the passage path 150*a*.

Another passage path 150*b* among the three passage paths has an end connected to the fourth transporter 160. For feeding the sheet toward the fourth transporter 160, the second diverting section 150 feeds the sheet by the pair of rollers 150*b*1 provided on the passage path 150*b*.

Still another passage path 150*c* among the three passage paths has an end connected to the third storage 220. For storing the sheet into the third storage 220, the pair of rollers 150*c*1 provided on the passage path 150*c* feed the sheet toward the third storage 220. For feeding the sheet stored in the third storage 220 into the second diverting section 150, the pair of rollers 150*c*1 provided on the passage path 150*c* feed the sheet to the inside.

A space having a substantially triangular prism shape is formed in the diverting section main body 150*e* of the second diverting section 150. The passage paths 150*a*, 150*b* and 150*c* are confluent in the space.

The selector 150*d* is formed to have an A-shape in left side view, and is provided turnably about a horizontal axis extending in the lateral direction. The selector 150*d* is controlled to have a predetermined attitude, thereby diverting the sheet fed into the space in the diverting section main body 150*e*, to a desired passage path.

Hereinafter, a position where a trajectory drawn by the sheet having passed through the passage path 150*a* and then been diverted to the fourth transporter 160, and a trajectory drawn by the sheet having passed through the passage path 150*a* and then been diverted to the third storage 220 branch off from each other is called a diversion point B1. A position where a trajectory drawn by the sheet having passed through the passage path 150*a* and then been diverted to the fourth transporter 160, and a trajectory drawn by the sheet having been stored in the second storage 210 and been fed toward the fourth transporter 160 become confluent is called a confluence point B2.

The third diverting section 170 is a diverting device that diverts the path to three directions and is for diverting the sheet.

The third diverting section 170 includes: a cylindrical diverting section main body 170*e*; a selector 170*d* that is stored in the diverting section main body 170*e* and turns centered at the central axis of the diverting section main body 170*e* as a turning center; three passage paths 170*a*, 170*b* and 170*c* formed to extend outward from the cylindrical surface of the diverting section main body 170*e*; and pairs of rollers 170*a*1, 170*b*1 and 170*c*1 provided on the respective passage paths.

The third diverting section 170 may be configured as an unit including the diverting section main body 170*e*, the selector 170*d*, the passage paths 170*a*, 170*b* and 170*c*, and the pairs of rollers 170*a*1, 170*b*1 and 170*c*1. Alternatively, each element may be configured as a separated member.

One passage path 170*a* among the three passage paths has an end connected to the fourth transporter 160. The third diverting section 170 feeds the sheet transported by the fourth transporter 160 to the inside by the pair of rollers 170*a*1 provided on the passage path 170*a*.

Another passage path 170*b* among the three passage paths has an end connected to the fifth transporter 180. For feeding the sheet toward the fifth transporter 180, the third diverting section 170 feeds the sheet by the pair of rollers 170*b*1 provided on the passage path 170*b*.

Still another passage path 170*c* among the three passage paths has an end connected to the fourth storage 230. For storing the sheet into the fourth storage 230, the pair of rollers 170*c*1 provided on the passage path 170*c* feed the sheet toward the fourth storage 230. For feeding the sheet stored in the fourth storage 230 into the third diverting section 170, the pair of rollers 170*c*1 provided on the passage path 170*c* feed the sheet to the inside.

A space having a substantially triangular prism shape is formed in the diverting section main body 170*e* of the third diverting section 170. The passage paths 170*a*, 170*b* and 170*c* are confluent in the space.

The selector 170*d* is formed to have an A-shape in left side view, and is provided turnably about a horizontal axis extending in the lateral direction. The selector 170*d* is controlled to have a predetermined attitude, thereby diverting the sheet fed into the space in the diverting section main body 170*e*, to a desired passage path.

Hereinafter, a position where a trajectory drawn by the sheet having passed through the passage path 170*a* and then been diverted to the fifth transporter 180, and a trajectory drawn by the sheet having passed through the passage path 170*a* and then been diverted to the fourth storage 230 branch off from each other is called a diversion point C1. A position where a trajectory drawn by the sheet having passed through the passage path 170*a* and then been diverted to the fifth transporter 180, and a trajectory drawn by the sheet having been stored in the fourth storage 230 and having been fed toward the fifth transporter 180 become confluent is called a confluence point C2.

In the embodiment of the present invention, the second diverting section 150 is embedded in the sheet processing apparatus 10 with an attitude where the diversion point B1 and the confluence point B2 of the second diverting section 150 have the same height. The third diverting section 170 is embedded in the sheet processing apparatus 10 with an attitude where the diversion point C1 and the confluence point C2 of the third diverting section 170 have the same height.

Meanwhile, the first diverting section 130 disposed on the most rear surface side (i.e., a position most apart from the input section 100) is embedded in the sheet processing apparatus 10 so that the diversion point A1 of the first diverting section 130 can be disposed higher than the confluence point A2. That is, the first diverting section 130 is embedded in the sheet processing apparatus 10 with an attitude rotated clockwise in left side view with reference to the attitudes of the second diverting section 150 and the third diverting section 170.

Accordingly, the position of the diversion point A1 of the first diverting section 130 can be moved to the front surface side, and the length in the front and rear direction of the sheet processing apparatus 10 can be reduced.

The second storage 210, the third storage 220 and the fourth storage 230 are storages that store and dispense the sheet. As illustrated in FIG. 1, the second storage 210, the third storage 220 and the fourth storage 230 are disposed at positions more apart from the input section 100 than the first storage 250 is. The second storage 210, the third storage 220 and the fourth storage 230 are winding storages.

Here, the winding storage is a storing unit that causes a drum provided in the unit to wind up and release the sheet together with belt-shaped tapes, thus storing and ejecting the sheet. The drum is a rotation body.

One ends of a pair of belt-shaped tapes are connected to the outer periphery of the drum. When the drum is rotated counterclockwise in left side view, the belt-shaped tapes are wound up by the drum. At this time, one sheet is clamped by each pair of belt-shaped tapes, and the sheet is wound up by the drum together with the belt-shaped tape.

When the drum is rotated clockwise, the belt-shaped tapes are released from the drum. At this time, the sheet clamped between the pair of the belt-shaped tapes is fed from the position between the belt-shaped tapes.

A passage port for the sheet is formed on the upper surface of the second storage 210. The transport path 145 connected to the passage path 130*c* communicates with the passage port. The second storage 210 causes the drum to wind up the sheet received through the passage port, thereby storing the sheet in this unit. The second storage 210 releases the sheet wound up by the drum, thereby feeding the sheet through the passage port toward the first diverting section 130.

A passage port for a sheet is formed on the upper surface of the third storage 220. The passage path 150*c* of the second diverting section 150 communicates with the passage port. The third storage 220 causes the drum to wind up the sheet received through the passage port, thereby storing the sheet in this unit. The third storage 220 releases the sheet wound up by the drum, thereby feeding the sheet through the passage port toward the second diverting section 150.

A passage port for a sheet is formed on the upper surface of the fourth storage 230. The passage path 170*c* of the third diverting section 170 communicates with the passage port. The fourth storage 230 causes the drum to wind up the sheet received through the passage port, thereby storing the sheet in this unit. The fourth storage 230 releases the sheet wound up by the drum, thereby feeding the sheet through the passage port toward the third diverting section 170.

The sixth transporter 240 is a transport path branched off from the fifth transporter 180. The sixth transporter 240 transports the sheet toward the first storage 250.

A diverter 270 is provided at a diverter section at which the sixth transporter 240 is branched off from the fifth transporter 180. The diverter 270 has a function of diverting the sheet transported by the fifth transporter 180 to any of the dispensing section 190 and the first storage 250.

The first storage 250 is a stacking storage that stores the sheet transported by the sixth transporter 240. The first storage 250 stores the sheet through a reception port formed at an upper portion. The first storage 250 internally includes a storage box 251. The storage box 251 is detachable to the front from the housing 20 (i.e., in a direction apart from the second storage 210). The first storage 250 may be a winding storage.

The first storage 250 is formed lower than the second storage 210, the third storage 220 and the fourth storage 230. That is, the upper end of the first storage 250 resides at a position lower than the upper ends of the second storage 210, the third storage 220 and the fourth storage 230.

The dispensing section 190 is a dispensing device that dispenses, to the outside, sheets stored in the second storage 210, the third storage 220 and the fourth storage 230, and a sheet input from the input section 100 and determined as a sheet to be rejected by the recognition unit 110. The dispensing section 190 includes a stacking unit 190*a* that stacks sheets transported by the fifth transporter 180.

A concave is provided frontward of the stacking unit 190*a*. The user can take the sheets stacked in the stacking unit 190*a*, by inserting a hand into the concave disposed below the sheets.

The shutter 200 is an opening and closing member that opens and closes the outlet of the dispensing section 190. The shutter 200 is opened and closed by a shutter drive device 200*a* provided on the rear surface side of the shutter 200. The shutter 200 covers the dispensing section 190 in a closed state, and opens the dispensing section 190 in an open state. The shutter drive device 200*a* may have a configuration where this device is locked in the closed state to thereby prohibit the shutter from being opened, and is unlocked to thereby allow the shutter 200 to be opened.

Next, the operation of each section in a case where the sheet is input into the sheet processing apparatus 10 is described. First, the operation of each section in a case where the input sheet is stored in the second storage 210 is described as an example.

The sheet is input through the input section 100 provided on the front surface of the sheet processing apparatus 10.

The input sheet is transported to the recognition unit 110 by the first transporter 120. The recognition unit 110 determines the type, authenticity, and presence or absence of damage. When the sheet is determined to be a genuine note and without damage by the recognition unit 110, the storage where the sheet is to be stored is determined among the second storage 210, the third storage 220 and the fourth storage 230 according to the type. If the input sheet is determined to be a counterfeit note or have damage by the recognition unit 110 for example, the sheet is determined to be stored in the first storage 250.

Irrespective of the recognition result by the recognition unit 110, the sheet is transported by the first transporter 120 to the rear surface side of the sheet processing apparatus 10. The sheet transported by the first transporter 120 is changed in transport direction at the turning-back section 125, and is transported by the second transporter 135 to the front surface side.

If the sheet is to be stored in the second storage 210, the control section controls the selector 130*d* of the first diverting section 130 so that the passage paths 130*a* and 130*c* of the first diverting section 130 can communicate with each other.

The sheet diverted by the first diverting section 130 to the second storage 210 is fed toward the second storage 210 and is stored in the second storage 210. At this time, the sheet is wound up together with the pair of belt-shaped tapes by the drum rotating counterclockwise in left side view in the second storage 210.

Next, the operation of each section in a case where the input sheet is stored in the first storage 250 is described as another example.

If the input sheet through the input section 100 is determined to be a counterfeit note by the recognition unit 110 for example, the sheet is stored in the first storage 250. When the sheet is stored in the first storage 250, the sheet sequentially passes through the first transporter 120, the turning-back section 125, the second transporter 135, the first diverting section 130, the third transporter 140, the second diverting section 150, the fourth transporter 160, the third diverting section 170, the fifth transporter 180, and the sixth transporter 240, and is stored in the first storage 250.

At this time, the selector 130*d* of the first diverting section 130 is controlled so that the passage paths 130*a* and 130*d* of the first diverting section 130 can communicate with each other. The selector 150*d* of the second diverting section 150 is controlled so that the passage paths 150*a* and 150*b* can communicate with each other. The selector 170*d* of the third diverting section 170 is controlled so that the passage paths 170*a* and 170*b* can communicate with each other. The diverter 270 is controlled so as to divert the transported sheet to the sixth transporter 240.

As described above, the storage box 251 of the first storage 250 is provided in the housing 20 detachably to the front. A counterfeit note or the like stored in the first storage 250 is taken out from this unit and collected by the user or the like.

Next, the operation of each section in a case where the sheet stored in the sheet processing apparatus 10 is dispensed is described. Here, the operation of each section in a case where the sheet stored in the second storage 210 is dispensed to the dispensing section 190 is described as an example.

When the sheet fed from the second storage 210 is dispensed to the dispensing section 190, the drum of the second storage 210 rotates clockwise in left side view to release the pair of belt-shaped tapes. At this time, the sheet wound up together with the pair of belt-shaped tapes is fed through the passage port of the second storage 210 toward the first diverting section 130.

At this time, the control section controls the selector 130*d* of the first diverting section 130 so that the passage paths 130*c* and 130*b* can communicate with each other. The control section controls the selector 150*d* so that the passage paths 150*a* and 150*b* of the second diverting section 150 can communicate with each other. The selector 170*d* is controlled so that the passage paths 170*a* and 170*b* of the third diverting section 170 can communicate with each other.

Consequently, the sheet fed from the second storage 210 sequentially passes through the first diverting section 130, the third transporter 140, the second diverting section 150, the fourth transporter 160, the third diverting section 170, and the fifth transporter 180, and is dispensed to the dispensing section 190. The sheet dispensed to the dispensing section 190 is stacked in the stacking unit 190*a* of the dispensing section 190.

After stacking of the dispensed sheets in the stacking unit 190*a* is completed, the control section drives and controls the shutter drive device 200*a* to bring the shutter 200 into the open state.

After the shutter 200 is opened, the user can take the sheet stacked in the stacking unit 190*a*.

In the embodiment of the present invention, the transporter that transports the sheet frontward is formed so as to descend toward the front. The dispensing section 190 is provided at a lower position accordingly. Consequently, the upper area of the dispensing section 190 can be enlarged.

In this case, even if the dispensing section 190 and the shutter 200 are formed to be large, the shutter 200 can be opened largely above. Consequently, the sheets stacked in the stacking unit 190*a* can become easily viewable by the user, and the sheets can be smoothly taken from the dispensing section 190 even if the fingers and thumb of the user are relatively thick. Furthermore, the dispensing section 190 can be formed large, which can increase the amount of stackable sheets.

Figure 3:
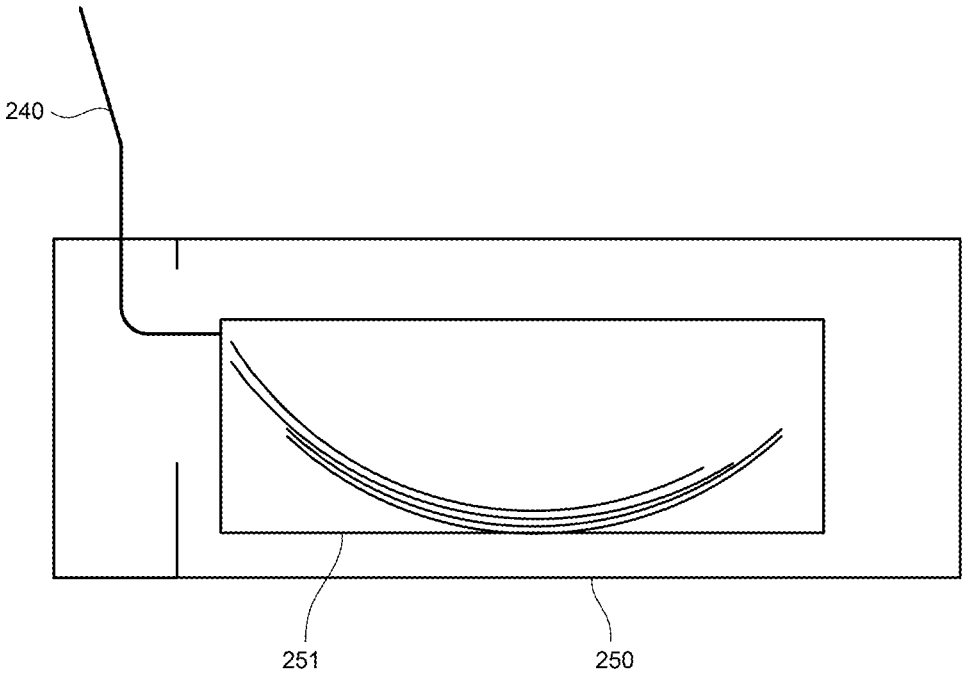
FIG. 3 illustrates a situation where a sheet jam occurs at a first storage.

Next, a configuration for preventing the sheet from jamming the first storage 250 is described. FIG. 3 illustrates a situation where a sheet jam occurs at the first storage 250.

The second storage 210, the third storage 220 and the fourth storage 230 are winding storages that wind up a sheet by a cylindrical drum. Consequently, sheets get a tendency to have an arched and curved shape after being stored in the storage. If the sheet having the tendency to have an arched and curved shape is stored in the first storage 250, the sheet is stacked with the shape being arched and curved as it is.

It is herein assumed that the drums of the second storage 210, the third storage 220 and the fourth storage 230 wind up the sheet by rotating clockwise in left side view, and release and feed the sheet by rotating counterclockwise. In this case, the sheets fed from these storages are stacked in the storage box 251, with shapes being warped convex downward. That is, as illustrated in FIG. 3, there is a possibility that the opposite ends of the sheets at the front and the rear rise. In this case, the sheet being transported by the sixth transporter 240 collides with the ends of the sheets stacked in the storage box 251 to jam therein.

Accordingly, in the embodiment of the present invention, the sheets are stacked in the storage box 251 of the first storage 250, with the sheets being warped convex upward. That is, the present invention has the configuration where the drums of the second storage 210, the third storage 220 and the fourth storage 230 store the sheet by rotating counterclockwise in left side view, and release and feed the sheet by rotating clockwise.

Consequently, according to the sheet processing apparatus 10 of the present invention, the opposite ends of the sheets do not rise in the storage box 251 of the first storage 250, and the apparatus is resistant to sheet jam.

In the embodiment of the present invention, parts of the third transporter 140 and the fifth transporter 180 are inclined downward, thereby forming stepwise the transport path toward the front (second transport path section). However, the mode of stepwise formation is not limited thereto.

For example, the first diverting section 130, the second diverting section 150 and the third diverting section 170 are disposed sequentially from a higher position to a lower position. The second diverting section 150 and the third diverting section 170 are disposed so that the diversion points B1 and C1 are at positions higher than the confluence points B2 and C2, in a manner analogous to that of the first diverting section 130. The third transporter 140, the fourth transporter 160 and the fifth transporter 180 are formed horizontally toward the front.

Accordingly, the second diverting section 150 and the third diverting section 170 serve as a step portion of the transporters that transport the sheet toward the front. In this case, there is no need to incline partially the third transporter 140, the fourth transporter 160 or the fifth transporter 180; this facilitates manufacturing these transporters.

INDUSTRIAL APPLICABILITY

The present invention is largely applicable to a sheet processing apparatus that stores and ejects sheets.

REFERENCE SIGNS LIST

10 Sheet processing apparatus
20 Housing
100 Input section
110 Recognition unit
120 First transporter
125 Turning-back section
130 First diverting section
130*a*, 130*b*, 130*c* Passage path
130*a*1, 130*b*1, 130*c*1 Rollers
130*d* Selector
130*e* Diverting section main body
135 Second transporter
140 Third transporter
150 Second diverting section
150*a*, 150*b*, 150*c* Passage path
150*a*1, 150*b*1, 150*c*1 Rollers
150*d* Selector
150*e* Diverting section main body
160 Fourth transporter
170 Third diverting section
170*a*, 170*b*, 170*c* Passage path
170*a*1, 170*b*1, 170*c*1 Rollers
170*d* Selector
170*e* Diverting section main body
180 Fifth transporter
190 Dispensing section
190*a* Stacking unit
200 Shutter
200*a* Shutter drive device
210 Second storage
220 Third storage
230 Fourth storage
240 Sixth transporter
250 First storage
A1, B1, C1 Diversion point
A2, B2, C2 Confluence point

The invention claimed is:

1. A sheet processing apparatus, comprising:
an input section that receives a sheet;
a dispensing section that dispenses the sheet, the dispensing unit having an opening on the same side as the input section;
a transporter that transports the sheet input through the input section to the dispensing section, the transporter having a terminal end connected to the dispensing unit;
a storage that stores the sheet; and
at least one diverting section that diverts the sheet transported by the transporter to the storage,
wherein a diversion point at which the sheet is diverted by the at least one diverting section is provided at a position higher than the terminal end of the transporter, and the diverting section diverts the sheet to either of two directions.

2. The sheet processing apparatus according to claim 1, wherein the transporter includes:
a first transport path section that transports the sheet from a first side of the sheet processing apparatus where the input section is arranged to a second side of the sheet processing apparatus, the second side being opposite to the first side,
a second transport path section that transports the sheet toward the dispensing section from the second side to the first side, and
a turning-back section that connects the first transport path section and the second transport path section to each other, and
wherein at least a part of the second transport path section is formed inclined downward toward the terminal end.

3. The sheet processing apparatus according to claim 1, wherein the transporter includes:
a first transport path section that transports the sheet from a first side of the sheet processing apparatus where the input section is arranged to a second side of the sheet processing apparatus, the second side being opposite to the first side,
a second transport path section that transports the sheet toward the dispensing section from the second side to the first side, and
a turning-back section that connects the first transport path section and the second transport path section to each other, and
wherein at least a part of the second transport path section is formed stepwise downward toward the terminal end.

4. The sheet processing apparatus according to claim 1, further comprising a shutter, wherein the dispensing section is provided with the shutter covering the dispensing section.

5. The sheet processing apparatus according to claim 4, further comprising a drive mechanism driving the shutter arranged above the dispensing section.

6. The sheet processing apparatus according to claim 1, wherein the diversion point is provided at a position lower than the input section.

* * * * *